United States Patent [19]

Vetten

[11] 4,044,656

[45] Aug. 30, 1977

[54] DEVICE FOR THE PRE-FOLDING OF THE CLOSURE OF A FOLDING BOX

[75] Inventor: Wilhelm Vetten, Dusseldorf, Germany

[73] Assignee: Jagenberg Werke AG, Dusseldorf, Germany

[21] Appl. No.: 675,362

[22] Filed: Apr. 9, 1976

[30] Foreign Application Priority Data

May 7, 1975 Germany ..... 2520404

[51] Int. Cl.[2] ..... B31B 1/52

[52] U.S. Cl. ..... 93/44.1 GT; 93/49 R

[58] Field of Search ..... 93/36.8, 44.1 GT, 49 R, 93/53 R, 53 BF

[56] References Cited

U.S. PATENT DOCUMENTS

| | | | |
|---|---|---|---|
| 3,183,801 | 5/1965 | Egleston | 93/44.1 GT |
| 3,403,606 | 10/1968 | Gartin | 93/44.1 GT |
| 3,593,625 | 7/1971 | Garrett et al. | 93/44.1 GT X |
| 3,943,834 | 3/1976 | Vetten | 93/44.1 GT |

*Primary Examiner*—Roy Lake
*Assistant Examiner*—Howard N. Goldberg
*Attorney, Agent, or Firm*—Burgess, Dinklage & Sprung

[57] ABSTRACT

The invention relates to a process and apparatus for pre-folding and unfolding of a closure on a folding box of rectangular cross-section, which closure is formed of the creased unslotted end portion of the walls of the box of which two opposite closure panels are each provided with a pair of creases running from the corners and converging toward the center of the margin so as to form triangular pockets upon folding. The device comprises two pairs of folding tools at 90° to one another and means for displacing them. One of the pairs corresponding to the creased panels each is bifurcated with a folding tine which engages its panel at substantially one location during folding while the other tine in inactive and an unfolding tine which engages the opposite face of the same panel during unfolding while the folding tine is inactive. A plunger is moved into the box prior to folding to serve as a backing means and, by unfolding as described, the panels are restored to a position where they are at most only minimally contacted by the plunger during withdrawal from the box. Thus, if the end portion of the box carries an adhesive material for later closure, the adhesive will not be removed by sliding of the plunger therealong.

7 Claims, 9 Drawing Figures

DEVICE FOR THE PRE-FOLDING OF THE CLOSURE OF A FOLDING BOX

BACKGROUND

Figure 1:
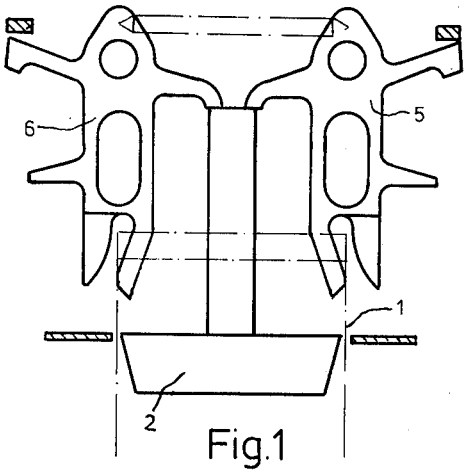

The invention relates to a device for the pre-folding of a closure on a folding box which is rectangular in cross section, and especially oblong-rectangular, at least in the area of the closure, the said closure formed from the creased but unslotted end portion of te walls of the said box, two confronting closure panels being each provided with a pair of creases running from the corners and converging towards the center of the margin for the formation by folding of triangulr pockets, the said device consisting of two pairs of folding tools which are placed at 90° to one another, the first pair of which, associated with the end panels provided with converging creases, being movable toward or away from one another, and the other pair being movable toward one another, the said device consisting also of a plunger disposed in the center between the folding tools and adapted to the free cross section of the box, which plunger serves as a backing means in the prefolding of the closure by the folding tools.

The pre-folding of a closure of an unfilled box serves to facilitate the later sealing of the filled box, because even with folding creases the top of the box cannot be perfectly folded and sealed when the box is full. To obviate these difficulties, it is common to pre-fold the end of the box which is provided with folding creases.

In one known device of the kind described above, the folding tools act exclusively externally on the top portion of the box. The folding tools associated with the top panels from which the triangular pockets are made are constructed as substantially triangular plates matching the pockets, while the other two folding tools are in the form of oblong rectangular blocks. With such a device a pre-folding can be achieved which is sufficient for the final folding that comes later on. However, it is disadvantageous that the end portion of the box remains more or less in the pre-folded condition after the pre-folding. This interferes with the further processing of the box, because the plunger cannot be withdrawn from the box unless the box is held. It then scrapes the inside surface of te box, which is coated with a thermoplastic material as an adhesive for the closure.

THE INVENTION

The invention is addressed to the problem of creating a device of the kind described above, in which the described difficulties with the pre-folded box top will be avoided.

This problem is solved by the invention in that, for the bilateral engagement of the closure panels provided with the converging creases, the folding toolsl associated therewith are constructed as forks adapted for straddling the edges of the box and having each a folding tine and an unfolding tine.

No difficulties are encountered in filling and sealing boxes which have been pre-folded with the device of the invention because, after it has been pre-folded, the end of the box is unfolded again. The effect of the pre-folding, which is to facilitate a clean final folding operation, is not lost when the box top is unfolded again. The unfolding, however, allows the plunger serving as the backing means to be withdrawn freely, without the need for the box to be held and without having the plunger scrape in a disadvantageous manner on the coated inside of the box top.

The folding tools required for the pre-folding and unfolding are very simple components and, since the same component serves both for the pre-folding and for the unfolding of the box top, the means for the driving of these components does not involve any greater expense than in the device of the prior art.

According to a development of the invention, the forked folding tools are each mounted for pivoting about an axis disposed perpendicularly to the plane of the fork on the end opposite the tines, the tines being curved against the folding direction. Preferably, the position of the pivoting axis, the degree of curvature of the tines and their aperture are interrelated such that, during the folding and unfolding of each closure panel, and latter will be engaged either by the folding tine only or by the unfolding tine only. This prevents the flat areas between the creases from being subjected in the folding operation to a bending stress such as would occur if they were engaged simultaneously by the folding and unfolding tines.

The driving of each folding tool can be such that the tool will be biased by a spring and will have a tilting lever that is actuated by a cam on a camshaft. To limit the range of movement of the folding tools it is desirable to provide stationary abutments for them.

Figure 2:
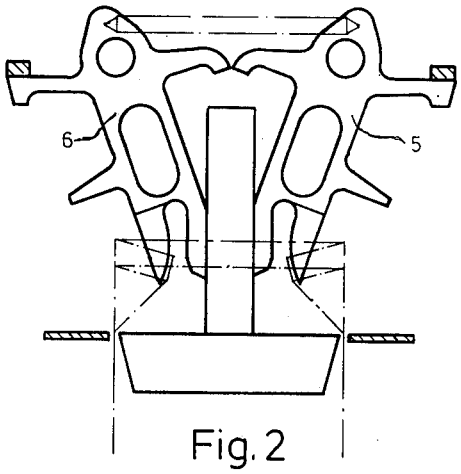
Figure 3:
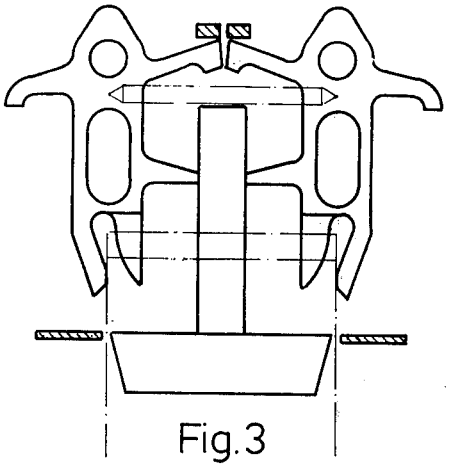
Figure 4:
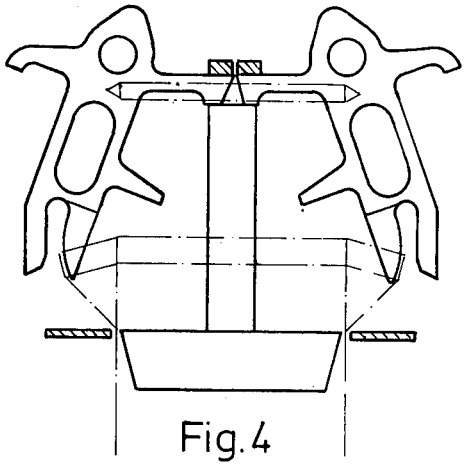
Figure 5:
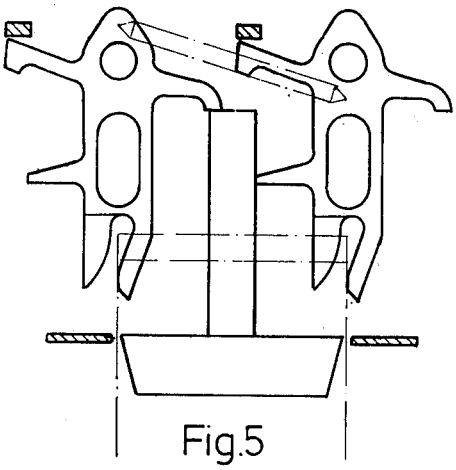
Figure 6:
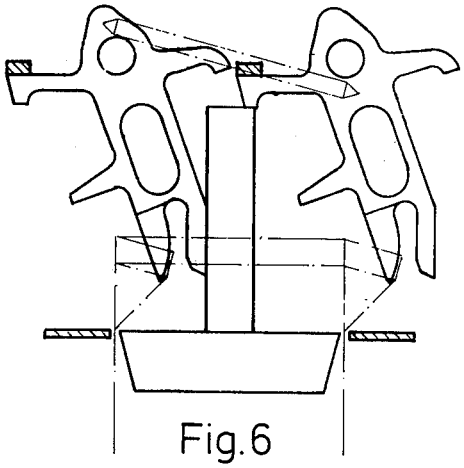
Figure 7:
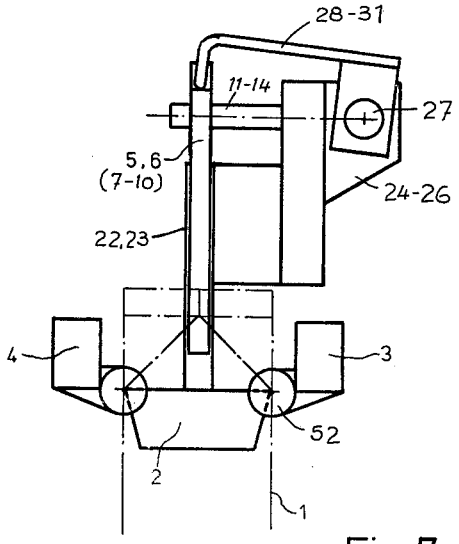
Figure 8:
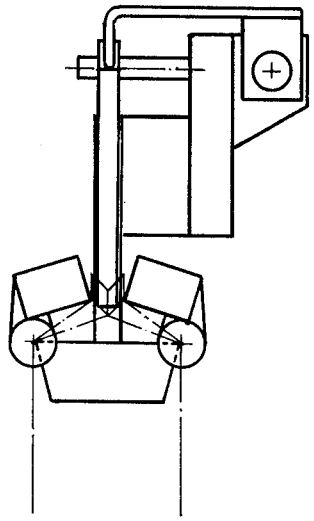
Figure 9:
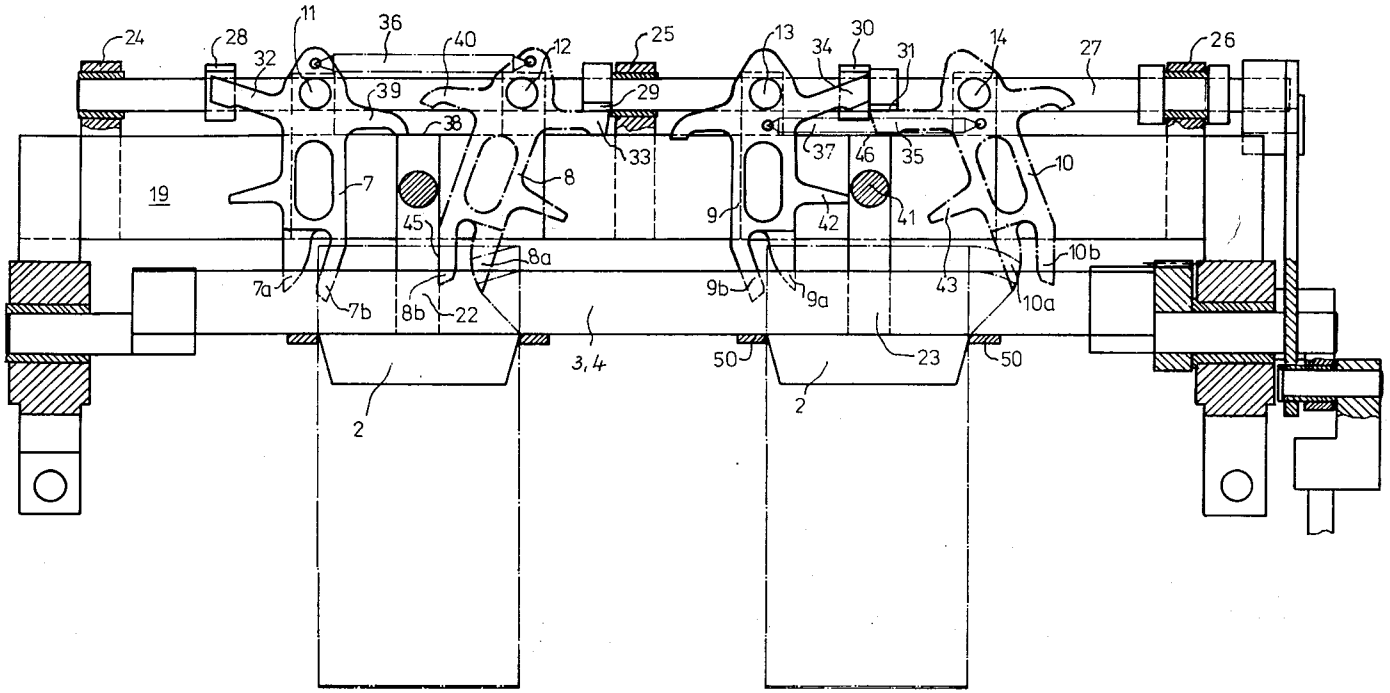

Special importance within the framework of the invention is to be attributed to the feature that the folding tools are reversible by 180° on their long axis. This feature is important because it permits folding from the inside and from the outside on the same device. The invention will now be further explained with the aid of a drawing representing an embodiment, wherein FIGS. 1 and 2 are diagrammtic front elevational views of an inwardly prefolding device without its drive, FIGS. 3 and 4 are similar views of an outwardly folding device, FIGS. 5 and 6 are similar views of a device folding inwardly on the one side and outwardly on the other, FIGS. 7 and 8 are side elevational views of the device, and FIG. 9 is a detailed representation showing a front and side view of two devices of FIGS. 1 and 3, disposed adjacent one another, with their drive.

Each device consists of a plunger 2 which can be introduced into a box 1 to serve as a backing means, and which for this purpose has a cross section matching the cross section of the box 1, two oblong rectangular folding tools 3 and 4 disposed on the long sides, which can be pivoted against one another, and two fork-like folding tools 5 and 6 at 90° thereto, which can be pivoted toward and away from one another. The device operates in principle such that, after the plunger 2 has been introduced into the box 1 and simultaneously the fork-like folding tools 5 and 6 have been lowered astride the narrower end panels of box 1, the folding tools 5 and 6 are rocked towards the long axis of the box or away from it, so that the panels engaged by these folding tools are folded to form a triangular pocket. At the same time the folding tools 3 and 4 act on the long sides. The upper marginal portion of plunger 2 serves as a backing means during the pre-folding by the folding tools 3, 4, 5 and 6, so that the box 1 is folded along the crease on its entire periphery. After this pre-folding procedure the folding tools 3 and 4 are retracted. Since they engage only the outside of the box, they are unable to turn back the end panels of the box. The fork-like folding tools 5 and 6, however, engage the end panels and in the manner turn the end panel of box 1 to its original state, in which the internal plunger 2 can by extracted from the box 1 without the need for the box to be held.

In order for the pre-folding and unfolding to be performed with suficient precision and with a minimum of harm to the closure as required for a perfect final sealing of the box, the fork-like folding members 5 and 6 have preferably a certain configuration and are able to be reversed selectively for an outward folding action and an inward folding action. Details of the configuration, mounting and drive of the folding tools 5 and 6 are represented in FIG. 9. Each folding tool 7, 8, 9 and 10 has two unlike prongs or tines, namely a folding tine *7a, 8a, 9a, 10a,* and an unfolding tine *7b, 8b, 9b, 10b.* The opening formed between the tines and facing the edge of the box is curved against the folding direction. The degree of curvature, the size of the opening and the position of the pivots 11, 12, 13 and 14 are interrelated such that the end panels of the box which are engaged by the tines *7a–10b* will be engaged only by folding tines *7a–10a* throughout the entire pre-folding operation, and only by the unfolding tines *7b–10b* during the unfolding operation. This is important so that the end panels will fold exclusively along the creases during the pre-folding and unfolding operations, so that the areas between said creases will remain flat.

The pivots 11–14 of the folding tools 7–10 are mounted in a common beam 19, on which the plunger *z* serving as backing means are also fastened by their flat stems 22 and 23. Additional bearing supports 24, 25 ad 26 are fastened to beam 19 for the support of a camshaft 27 serving for the actuation of the folding tools 7–10; this camshaft is driven by a drive which will be described further on.

Two confronting stationary guides 50 are provided for the holding of the package, which are located on the narrow sides of the package below the folding tools, at the level of the horizontal folding creases, where they prevent any bulging at the creases during the folding operation. In addition, they hold the carton while the plunger *2* is being extracted.

On the camshaft 27 a cam 28, 29, 30 ,31 is provided for each folding tool and cooperates with a tilting lever 32, 33, 34, 35, respectively. Each folding tool 7–10 is engaged by a spring 36, 37, such that the spring biases the folding tool 7–10 against the direction of folding. The cams 28–31 through tilting levers 32–35 act on the folding tools 7–10 against the bias of these springs. When the tilting levers 32–35 are not acted upon by cams 28–31, they are held by their springs 36–37 against an abutment. In the case of folding tools 7–8 installed for inward folding, the abutment is formed by the end face 38 of the plunger stem 22, which is engaged by the arms 39 and 40 of the folding tools 7 and 8. In the case of folding tools 9 and 10, which are installed for outward folding, the abutment is constituted by a stud 41 on the plunger stem 23, and is engaged by the arms 42 and 43 of folding tools 9 and 10. To limit the folding movement in the case of folding tools 7–8 installed for inward folding, the back edges 45 of the unfolding tines *7b–8b* are adapted for abutment against the plunger stem 22. In the case of folding tools 9–10 installed for outward folding, the tilting levers 34–35 limit the folding movement by abutting against the end face 46 of plunger stem 23.

In order to achieve the folding of the long panels of the box tops, a flat tool 3.4 is provided (FIGS. 7–9) which can be swung about an axis of rotation 52 which is offset from the flat tool and coincides with the folding crease on the long side of the box.

It will be appreciated that the instant specification and examples are set forth by way of illustration and not limitation, and that various modifications and changes may be made without departing from the spirit and scope of the present invention.

What is claimed is:

1. In a device for the pre-folding of a closure on a folding box of rectangular cross-section, which closure is formed of the creased unslotted end portion of the walls of the box of which two opposite closure panels are each provided with a pair of creases running from the corners and converging away therefrom so as to form triangular pockets upon folding, the device comprising two pairs of folding tools which pairs are at 90° to one another, means for displacing said folding tools so as to effect a pre-fold, a plunger corresponding in shape to the cross-section of the box, and means for reciprocating said plunger into and out of said box, said plunger when in said box serving as a backing means during a pre-folding tool of that pair which is associated with the creased opposite closure panel is bifurcated so as to have a folding tine and an unfolding tine, each of said bifuracted tools being positioned so that during pre-folding one tine is within said box and the other outside said box.

2. A device according to claim 1, wherein said means for displacing said folding tools includes a spring urging each bifurcated tool into a predetermined position, a tilting lever carried by each bifurcated tool, a cam operatively engageing said tilting lever, and a camshaft controlling said cam.

3. A device according to claim 1, wherein said plunger carries stationary abutments to engage respective portions of the folding tines of said bifurcated tools so as to limit displacement of said tools.

4. A device according to claim 1, wherein each of said bifurcated tools is mounted for pivotal displacement about an axis perpendicular to its plane and spaced from the tines, the tines being curved against the folding directions.

5. A device according to claim 4, wherein the axis of pivotal displacement of each bifurcated tool, the curvature of its tines and the spacing between the tines are so interrelated that during folding of a respective closure panel only one tine will contact said panel and during unfolding only the other tine will contact will panel.

6. A device according to claim 4, wherein each bifurcated tool is constructed so as to be capable of being mounted about its pivotal axis in either of two directions offset by 180° .

7. A device according to claim 5, wherein each bifuracted tool is constructed so as to be capable of being mounted about its pivotal axis in either of two directions offset by 180° , each means for displacing said folding tool including a spring urging each bifuracted tool into a predetermined position, a tilting lever carried by each bifurcated tool, a cam operatively engaging said tilting lever, and a camshaft controlling said cam, said plunger carrying stationary abutments to engage respective portions of the folding tines of said bifurcated tools so as to limit displacement of said tools.

* * * * *

UNITED STATES PATENT AND TRADEMARK OFFICE

CERTIFICATE OF CORRECTION

PATENT NO. : 4,044,656

DATED : Aug. 30, 1977

INVENTOR(S) : Wilhelm Vetten

It is certified that error appears in the above-identified patent and that said Letters Patent are hereby corrected as shown below:

| | | |
|---|---|---|
| Col. 1, | line 10 | Change "th" to--the-- |
| Col. 1, | line 14 | Change "triangulr" to--triangular-- |
| Col. 3, | line 30 | Change "plunger z" to--plungers-- |
| Col. 3, | line 32 | Change "ad" to--and-- |
| Col. 4, | line 2 | Change "3.4" to -- 3,4 --. |
| Col. 4, | line 25 | After "prefolding" insert--operation by said tools, the improvement wherein each folding-- |
| Col. 4, | line 28 | Change "bifuracted" to--bifurcated |
| Col. 4, | line 35 | Change "engageing" to--engaging-- |

UNITED STATES PATENT AND TRADEMARK OFFICE

CERTIFICATE OF CORRECTION

PATENT NO. : 4,044,656
DATED : Aug. 30 , 1977
INVENTOR(S) : Wilhelm Vitten (page 2 of 2)

It is certified that error appears in the above-identified patent and that said Letters Patent are hereby corrected as shown below:

| | | |
|---|---|---|
| Col. 4, | line 51 | Change "will" (2nd occurrence) to--said-- |
| Col. 4, | lines 56-57 | Change "bifuracted" to--bifurcated- |
| Col. 4, | line 60 | Change "bifuracted" to--bifurcated- |

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*